US009505518B2

(12) United States Patent
Mills et al.

(10) Patent No.: US 9,505,518 B2
(45) Date of Patent: Nov. 29, 2016

(54) CONTAINER AND BLANK

(75) Inventors: Frank Mills, Banbury (GB); Samantha Moore, Broughton Milton Keynes (GB)

(73) Assignee: COLPAC LIMITED, Flitwick, Bedfordshire (GB)

( * ) Notice: Subject to any disclaimer, the term of this patent is extended or adjusted under 35 U.S.C. 154(b) by 123 days.

(21) Appl. No.: 13/994,604

(22) PCT Filed: Dec. 19, 2011

(86) PCT No.: PCT/GB2011/001736

§ 371 (c)(1),
(2), (4) Date: Oct. 14, 2013

(87) PCT Pub. No.: WO2012/080708

PCT Pub. Date: Jun. 21, 2012

(65) Prior Publication Data

US 2014/0027501 A1 Jan. 30, 2014

(30) Foreign Application Priority Data

| | | |
|---|---|---|
| Dec. 17, 2010 | (GB) | 1021581.2 |
| Feb. 1, 2011 | (GB) | 1101747.2 |
| Mar. 17, 2011 | (GB) | 1104576.2 |

(51) Int. Cl.
*B65D 5/42* (2006.01)
*B65D 5/18* (2006.01)
(Continued)

(52) U.S. Cl.
CPC . *B65D 5/42* (2013.01); *B65D 5/18* (2013.01); *B65D 5/4279* (2013.01); *B65D 5/563* (2013.01); *B65D 81/2076* (2013.01); *B65D 85/36* (2013.01)

(58) Field of Classification Search
USPC ..... 229/117.08, 117.06, 117.05, 113, 116, 229/117.07, 938; 206/436, 551; 493/153, 493/121
See application file for complete search history.

(56) References Cited

U.S. PATENT DOCUMENTS 2,430,610 A 11/1947 Guyer
2,912,153 A * 11/1959 Lange ..... B65D 5/2076 229/102

(Continued)

FOREIGN PATENT DOCUMENTS

GB 1500304 A 2/1978
GB 2425524 A 11/2006

(Continued)

OTHER PUBLICATIONS

Office Action issued Jun. 17, 2015 for U.S. Appl. No. 14/369,691, 16 pages.

(Continued)

*Primary Examiner* — Christopher Demeree
(74) *Attorney, Agent, or Firm* — Smith IP Services, P.C

(57) ABSTRACT

The invention relates to a container and a blank for forming a container. In particular, the invention relates to a container for receiving a food product and having an improved hermetic seal to allow modified atmosphere packaging techniques to be used to extend the life of the container contents. The improved seal is achieved by avoiding or sealing gaps which can be present around the closure of the container. The container may comprise a container body with a plurality of walls formed by body panels of a folded blank such that each corner of the container opening is formed at the end of a fold line between two adjacent body panels of the blank. The invention also relates to a method for forming such a container.

11 Claims, 10 Drawing Sheets

(51) Int. Cl.

| | |
|---|---|
| ***B65D 5/56*** | (2006.01) |
| *B65D 81/20* | (2006.01) |
| *B65D 85/36* | (2006.01) |

(56) References Cited

U.S. PATENT DOCUMENTS

| | | | | |
|---|---|---|---|---|
| 4,304,352 | A | 12/1981 | Humphries | |
| 4,657,177 | A | 4/1987 | Karabedian | |
| 4,871,071 | A | 10/1989 | Zimmermann | |
| 4,930,639 | A | 6/1990 | Rigby | |
| 4,951,868 | A | 8/1990 | Mode | |
| 5,253,801 | A | 10/1993 | Bernstein et al. | |
| 6,431,365 | B1 * | 8/2002 | Money | 206/776 |
| 7,143,930 | B2 * | 12/2006 | Money et al. | 229/115 |
| 7,950,569 | B2 * | 5/2011 | Goldman et al. | 229/115 |
| 2010/0019020 | A1 * | 1/2010 | Phung et al. | 229/115 |
| 2010/0127054 | A1 | 5/2010 | Goldman et al. | |
| 2010/0155279 | A1 | 6/2010 | Wood | |
| 2015/0060535 | A1 | 3/2015 | Moore | |

FOREIGN PATENT DOCUMENTS

| | | | |
|---|---|---|---|
| GB | 2428234 | A | 1/2007 |
| GB | 2433064 | A | 6/2007 |
| GB | 2457943 | A | 9/2009 |
| GB | 2468193 | A | 9/2010 |
| WO | 2005051780 | A1 | 6/2005 |
| WO | 2013098544 | A1 | 7/2013 |

OTHER PUBLICATIONS

Office Action issued Dec. 21, 2015 for U.S. Appl. No. 14/369,691, 11 pages.

Office Action issued Apr. 15, 2016 for U.S. Appl. No. 14/369,691, 12 pages.

US Office Action issued Sep. 6, 2016 for U.S. Appl. No. 14/369,691, 7 pages.

* cited by examiner

Fig 7a
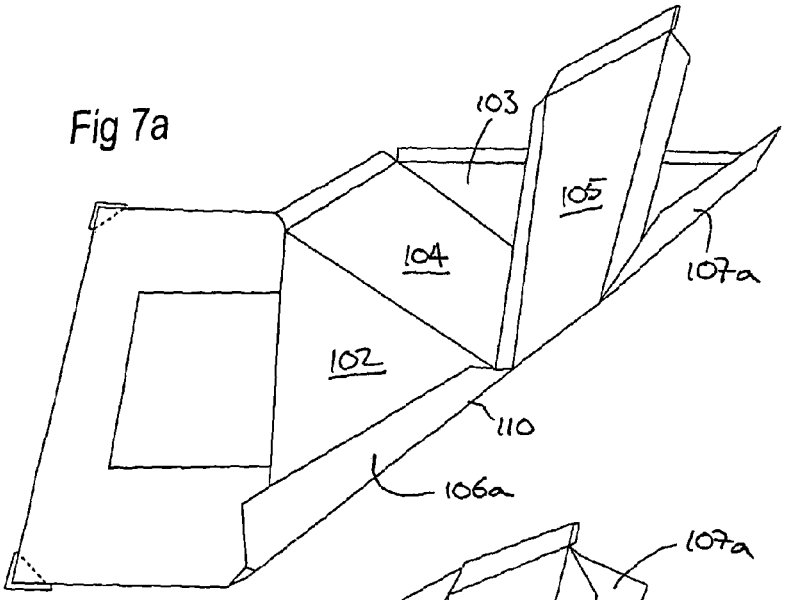
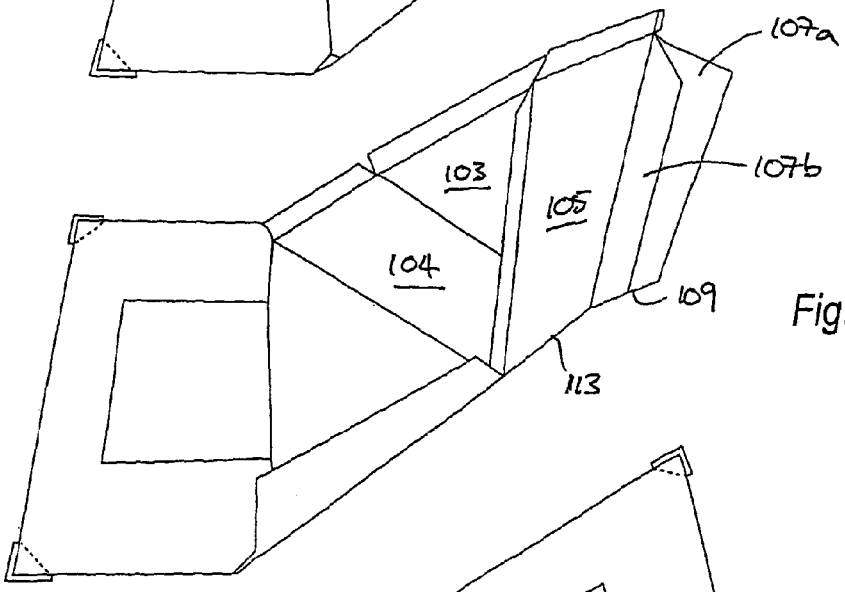
Fig. 7b
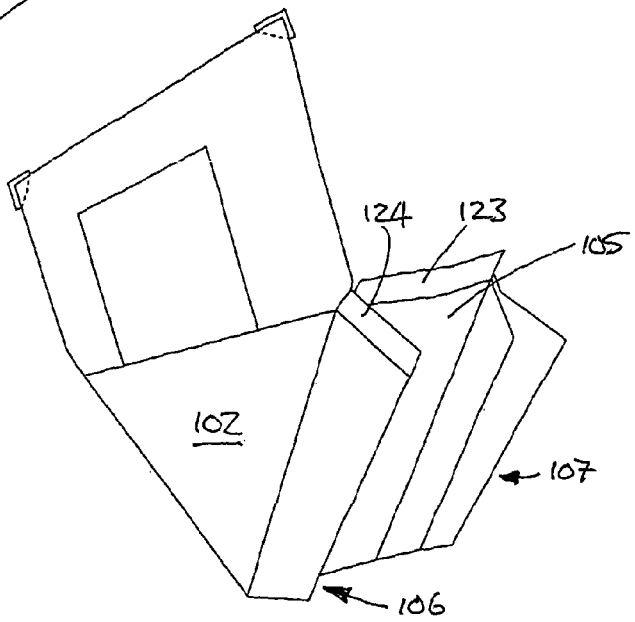
Fig. 7c

CONTAINER AND BLANK

CROSS-REFERENCE TO RELATED APPLICATIONS

This application is a national stage under 35 USC 371 of International Application No. PCT/GB001736, filed on 19 Dec. 2011, which claims priority to United Kingdom Patent Application No. 1104576.2, filed on 17 Mar. 2011, United Kingdom Patent Application No. 1101747.2, filed on 1 Feb. 2011, and United Kingdom Patent Application No. 1021581.2, filed on 17 Dec. 2010. The entire disclosures of these prior applications are incorporated herein by this reference.

The invention relates to a container, and particularly, but not exclusively to a container for receiving a food product, such as a sandwich container. The invention also relates to a blank for such a container and to a method for forming such a container.

It is known to package some food products, such as sandwiches, in hermetically sealed containers which are formed from a folded blank of material, such as paperboard. For the purpose of this specification 'paperboard' is considered to encompass paper, cardboard and similar materials.

In order to extend the shelf life of these packaged food products, it is desirable to reduce, preferably to zero, the amount of Oxygen remaining in said sealed container. This can be achieved by vacuum packaging, where the air within the packaging is simply removed, or gas flushing, where the atmosphere within the packaging is forced/flushed out by the addition of one or more gases such as Nitrogen, Argon or Carbon Dioxide. Most preferably, a technique known as 'modified atmosphere packaging' can be employed, whereby the air in the container is first removed and subsequently replaced by one or more gases as described above. The initial step of sucking out the air prevents residual Oxygen being left in the container, which is one typical problem associated with gas flushing.

For any of the above techniques to be effective, it is important that the sealed container is as airtight as possible. The success of modified atmosphere packaging in particular is highly dependent on the quality of the hermetic seal provided on the container.

Numerous attempts have been made to modify the design of packaging, in particular paperboard containers, in such a way that a suitable seal can be formed, and numerous patent applications have been filed directed to these developments. One key advance has been the use of continuous plastics films to provide an impermeable layer across the entirety of the interior surface of a paperboard container/blank. Increased use of heat-sealing techniques has also been of assistance, as has better design of the blanks themselves. However, there remains a need to further improve the integrity of such containers if modified atmosphere packaging is to be feasible.

For example, it can be difficult to completely eliminate discontinuities from the container body, in particular at the corners of a container opening, and from the interface between the body and the lid/closure of the container. Container blanks are commonly provided with panels to create an outwardly extending flange around the opening of the finished container to which a lid panel is bonded to close the container. However, because the blanks have to be folded into their final configuration, the flange forming portions have to be provided in several discrete sections. When the lid panel is bonded to the flange of the container, gaps between the flange sections are not sealed as effectively as the remainder of the flange and lid. This can compromise the integrity of the seal of the finished container.

The abovementioned gaps can often be minimised through careful design of the container blank, in particular by extending the length of one or more of the flange forming panels. However, in certain, otherwise preferable, blank configurations, it is not possible to extend the panels in this way, so relatively large gaps will remain.

It is an object of the present invention to provide a container and blank which addresses the abovementioned problem to provide an improved seal. It is an object of the present invention to provide a container, formed from a blank, which provides an improved seal for modified atmosphere packaging of the container contents to prolong the life of a product, for example a foodstuff, placed therein. It is a further object of the invention that formation of the container should be straightforward.

The present invention provides a container as defined in the appended claim 1, a container as defined in the appended claim 10, and a blank for forming a container as described.

Furtherer beneficial features of the containers and blanks are recited in the associated dependent claims.

Joining the lid to a part of the flange can help to avoid the presence of gaps in the flange at the corners of the container located at either end of the lid.

The provision of a foldable part of a lid which can be folded over at least a part of a container flange allows gaps which may exist in the flange to be sealed effectively.

The container may comprise a paperboard substrate and a liquid impermeable layer, which preferably comprises a layer of film. Said layer of film may extend beyond an edge of the paperboard substrate to create one or more film overhangs. Said film overhangs may, in particular, be provided at the foldable part of the lid, but may also be provided in other areas to improve sealing of the container.

The foldable portion of the lid may, for example, comprise a corner of the lid or an edge portion of the lid.

The lid may be a separate component from the container body, or may be joined thereto. In particular, the lid may be joined to a part of the flange of the container by a fold line.

The container is preferably formed from a folded blank. Each corner of the container opening may be formed at the end of a fold line between two of the body panels forming adjacent walls of the container body, and the container may further comprise closure forming means around said opening which is continuous around each corner of the opening. By continuous it is meant that the closure forming means is uninterrupted, for example by joins between non-adjacent parts of the blank. Alternatively, the blank may comprise webbing sections between panels which form adjacent walls of the finished container, said webbing sections being folded and bonded to the outside of the container. This avoids the presence of any cut edges on the interior of the finished container, which improves integrity by reducing the chance of ingress of grease or other liquids into the container material.

The blank for forming a container as defined above preferably comprises a paperboard substrate and a liquid impermeable layer, such as a layer of film. Said layer of film may extend beyond an edge of the paperboard substrate to create one or more film overhangs both in areas which will be free edges of the finished container. Overhangs may also be provided in other areas to improve the general sealing of the container body formed from said blank, for example between adjacent webbing portions, at a free end of one or more webbing portions and/or beyond a free edge of at least one flange section, for example between two adjacent flange sections. In certain embodiments, one or more sections of the flange, in particular a section to which a closure of the container is joined, may be provided solely by a film layer extending beyond a paperboard substrate. The film may be heat sealable if desired.

The present invention also provides a container according to the appended claim 31 and a blank for forming such a container. Further beneficial features are recited in the associated dependent claims.

Further advantageous features of the invention are recited in the dependent claims.

As mentioned above, the corners of a container opening are typically some of the most difficult parts of the container to seal. Various methods of overcoming this problem have been proposed, but most require a complex arrangement of additional panels or areas of film to seal the corner in question, or require that the corner is formed at a fold between adjacent panels of blank. However, containers formed from blanks most commonly have at least one corner formed by a join between two non-adjacent panels of the blank, which prevents these solutions from being employed. The present invention ensures that every corner of the container is formed by a fold line rather than a join between ends of the container blank. As such, sealing of all corners of the container is simplified.

The container is formed from a folded blank, but each corner of the container opening is formed at the end of a fold line between two of the body panels forming adjacent walls of the container body, and the container further comprises closure forming means around said opening which is continuous around each corner of the opening. By continuous it is meant that the closure forming means is uninterrupted, for example by joins between non-adjacent parts of the blank.

The closure forming means may comprise a flange around at least a part of the container opening. Preferably, the flange is formed by a plurality of outwardly folded panels of the blank, each being joined to a body panel by a fold line.

The container may comprise a paperboard substrate and a liquid impermeable layer, which preferably comprises a layer of film. Said layer of film may extend beyond an edge of the paperboard substrate to create one or more film overhangs. Said film overhangs may, in particular, be provided at the foldable part of the lid, but may also be provided in other areas to improve sealing of the container.

Gaps that exist between the outwardly folded panels may be spanned by the impermeable film, which is preferably capable of stretching. Since each corner of the container opening is formed at a fold line of the blank, the spanning film can easily be provided at any corner of the container opening.

The impermeable film is preferably a plastics film, for example comprising a plurality of layers of plastics material which may be coextruded. One suitable film could comprise a layer of Ethylene Vinyl Alcohol (EVOH) between two layers of Low Density Polyethylene (LDPE).

The plastics film is preferably provided over the entire interior surface of the container.

The closure forming means of the container may further comprise a lid panel. The lid panel may be joined by a fold line to a body panel and the remainder of the closure means.

Joining the lid panel to an adjacent part of closure means, for example a flange, can help to avoid the presence of gaps in the flange at the corners of the container located at either end of the lid.

The provision of a foldable part of a lid panel which can be folded over at least a part of a container flange allows gaps which may exist in the flange to be sealed effectively.

The foldable portion of the lid may, for example, comprise a corner of the lid or an edge portion of the lid.

Preferably, one wall of the container body comprises a join formed between two body panels of the blank. The closure forming means may then comprise a continuous piece of material around the container opening starting and ending at the join. The join may be in the middle of a wall panel, but need not be. The important thing is that by relocating the join from a corner of the container to a point in a planar wall, sealing around the join is greatly simplified.

The join may be formed by bonding a first tab, which is joined to, and folded back against, a first body panel, to a further body panel such that an additional panel is formed on the exterior of one of the container walls, overlying a part of the first body panel. The additional panel provides extra strength to the container, and the folding back of the tab ensures that a good seal is obtained.

Preferably, the first body panel is joined by a fold line to a first closure forming panel and the further body panel is joined by a fold line to a further closure forming panel, and an edge of the first closure forming panel abuts an edge of the further closure forming panel. This arrangement ensures that there is not an overlap of panels in the flange of the finished container, which is beneficial in ensuring that a lid can be reliable sealed over the container opening.

A tortuous seam/join in the container can be provided if the edges of the first and further closure forming panels are at an oblique angle to the join in the container body. This tortuous seam is of benefit in preventing gas from leaking either into of out of the finished container.

An area of unsupported plastics film is provided between said edge of the first closure forming panel and the first tab, and preferably the further closure forming panel is bonded to said area of unsupported plastics film. This arrangement provides a good seal across the join. A particularly good seal can be provided if the film area extends across a fold line between the first body panel and the first tab, such that a double layer of film is provided when folding back the first tab to form the container. The unsupported film layer is preferably covered by the material of the blank substrate, for example as a result of the arrangement of closure forming panels described above, to protect the film from the direct application of heat in a heat sealing process.

The same features described above may also be applied to the sealing of an apex of the container. First and further small tabs may be provided at an edge of the first and further body panels opposite to the edges where the first and further closure forming panels are provided, and may have the same beneficial features referred to above. Whereas the first and further closure forming panels are bonded to a lid panel in the finished container, the first and further small tabs may be bonded to a third small tab provided on a third body panel of the blank.

The features above serve to prevent heat sealing from having to be applied through double layers of substrate being whilst still providing a layer to protect the delicate plastics film. Similar features may be provided to achieve the same effect on other parts of the container, for example where further tabs, joined by fold lines to body panels, need to be sealed together to form the container.

The container may be a sandwich container, in particular a generally triangular sandwich container for diagonally cut sandwiches. In such a case, it is often preferable that the join is provided in a generally rectangular wall of the container rather than in a triangular wall. The container may also be a container for various other foodstuffs and other products.

Providing a join in a triangular wall is also possible, and more than one join can be provided as described above if required.

The invention also provides a blank for forming a container as previously described.

Preferably, the blank comprises a substrate layer, for example of paperboard, having a plurality of body panels and a plurality of closure forming panels joined to edges of the body panels which, in use, define the opening of the container. The body panels and closure forming panels may be defined by fold lines or score lines in the substrate layer, and an impermeable film preferably covers the entire substrate layer and spans gaps between adjacent closure panels.

One of the closure panels may be provided as a lid panel joined by a fold line to one body panel and two other closure forming panels. Joining a lid panel by fold lines to other closure forming panels eliminates the gaps that can exist at the corners of a container opening where a lid is provided.

A first body panel of the blank is preferably provided with a first tab which, in use, is joined to a further body panel such that said two body panels together form a single wall of a container body. An additional fold line may also be provided in one body panel, preferably in the body panel which, in use, forms the container wall opposite to that formed by two body panels. The fold line may be in the middle of said body panel, but this is not essential.

A method of forming a container from the blank described comprises the steps of folding the blank, possibly at the additional fold mentioned above, such that the first tab overlies an edge of said further body panel, bonding said first tab to said further body panel, and folding said first tab back against the first body panel to open out the container body. Further tabs provided on said first and further body panels may then be bonded to similar tabs provided on a third body panel to form the container body. Preferably the bonding is achieved by heat sealing.

In all cases, the container may further comprise a frangible opening, for example comprising score lines in the lid and flange. Alternatively, or additionally, the container may comprise heat activated sealing means, such as resin dots, located at vertices of the container, for example at the interface of the lid and the container opening. The film layer, where provided, may be perforated or otherwise be air permeable if desired.

A better understanding of the present invention will be obtained from the following detailed description. The description is given by way of example only and makes reference to the accompanying drawings in which.

Figure 6:
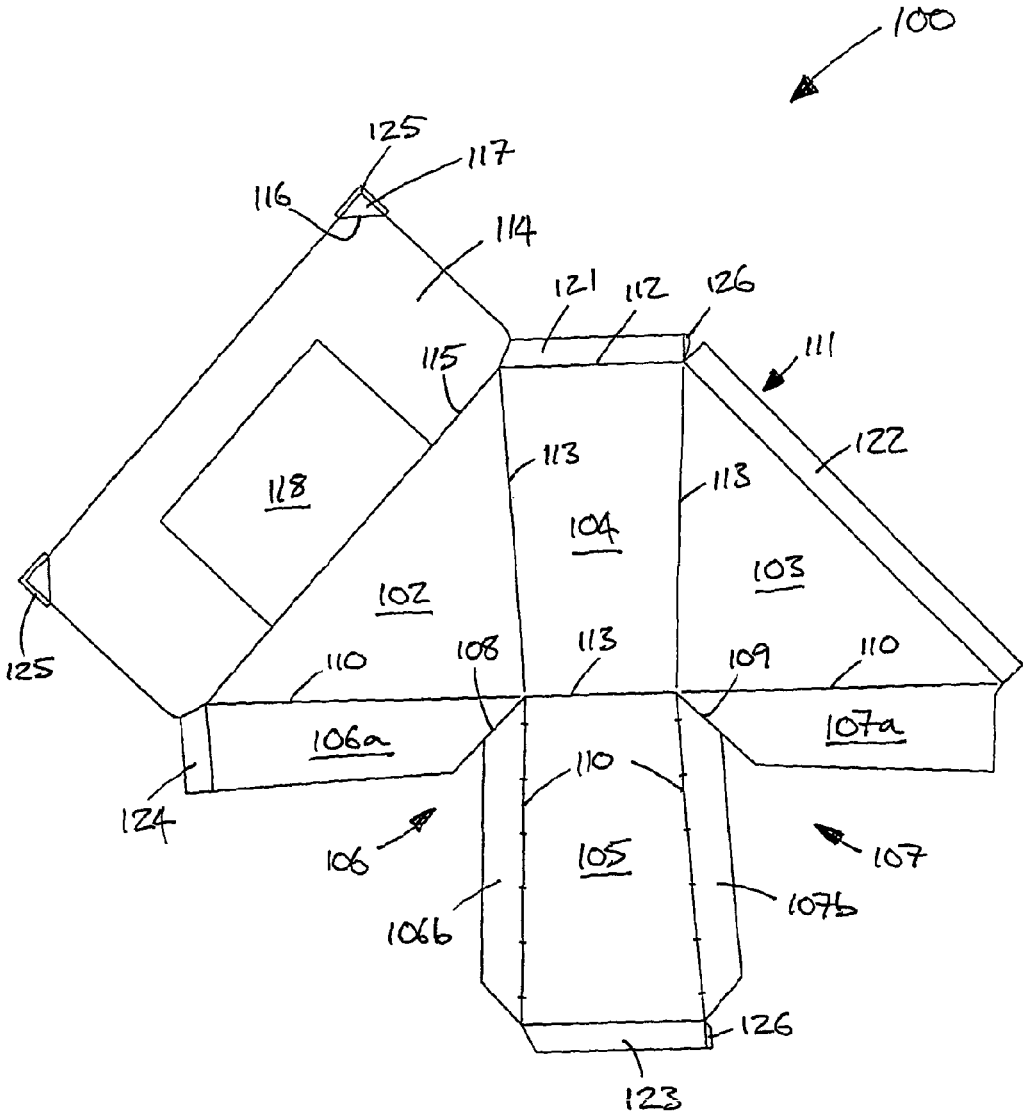
FIG. 6 is a plan view of a container blank according to a further embodiment of the present invention.
Figure 8:
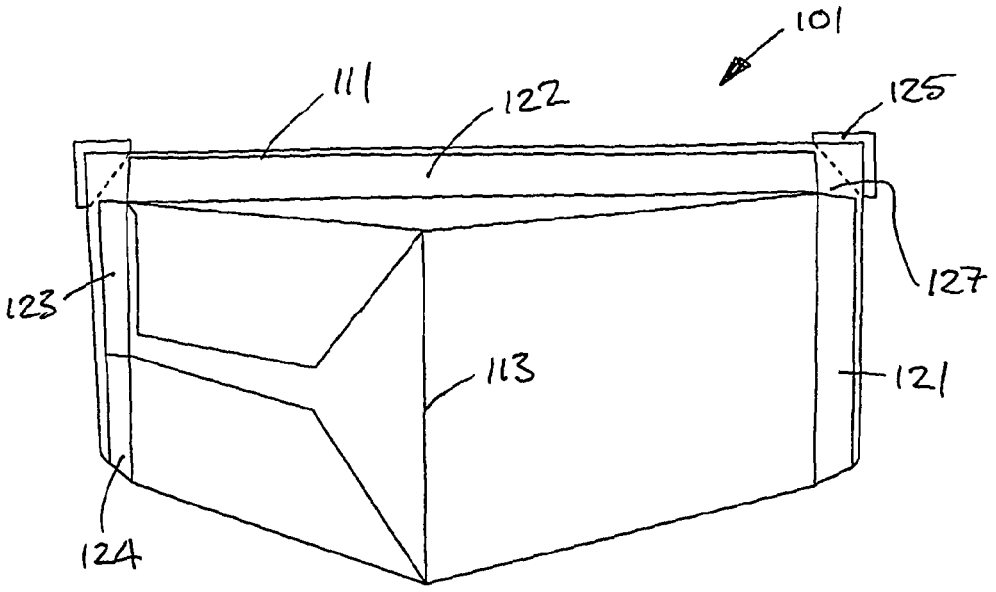
Figure 9:
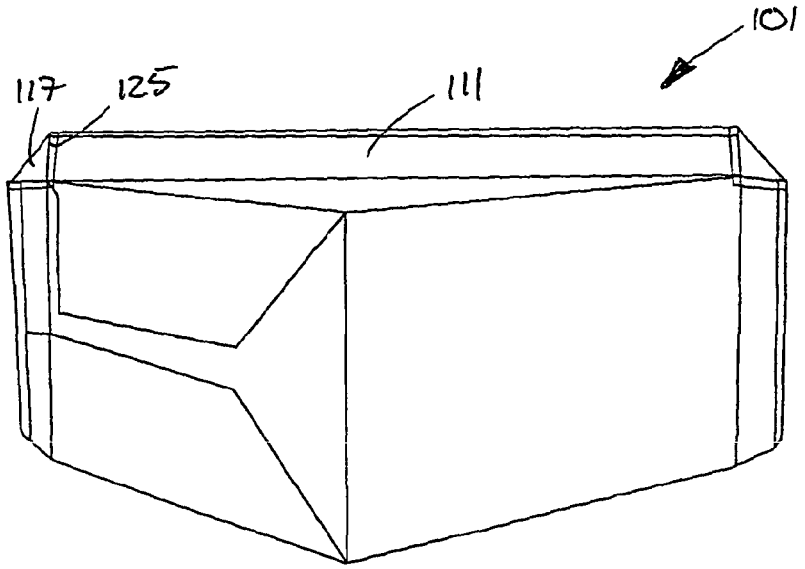
Figure 10:
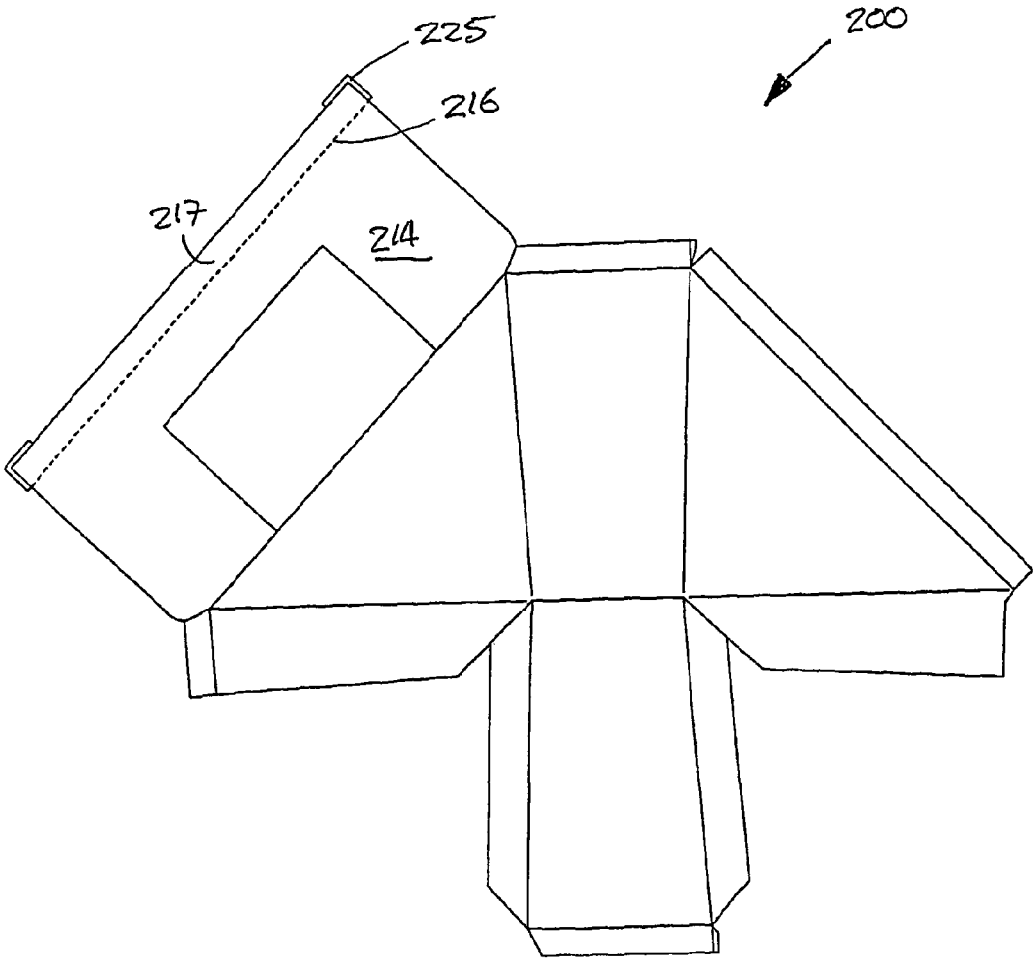
Figure 11:
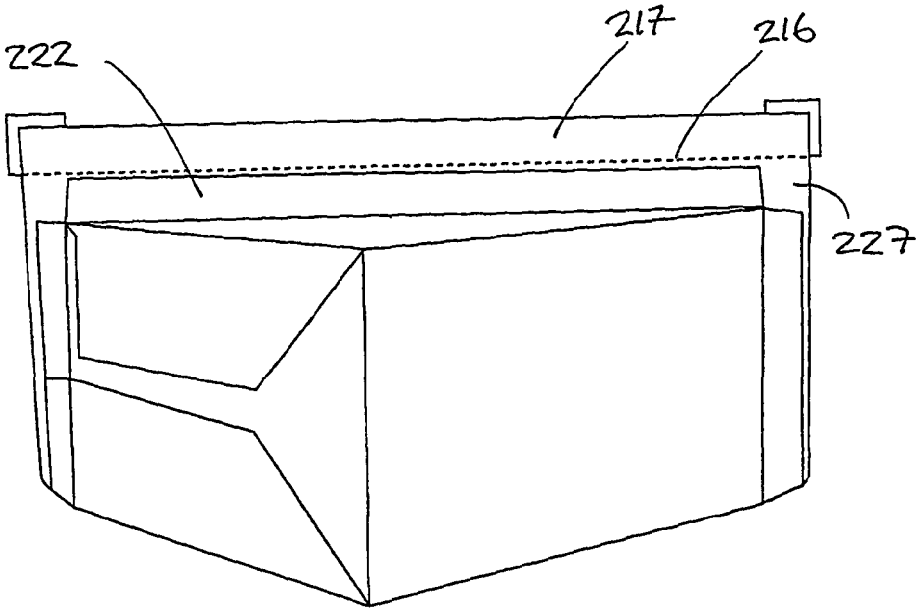
Figure 12:
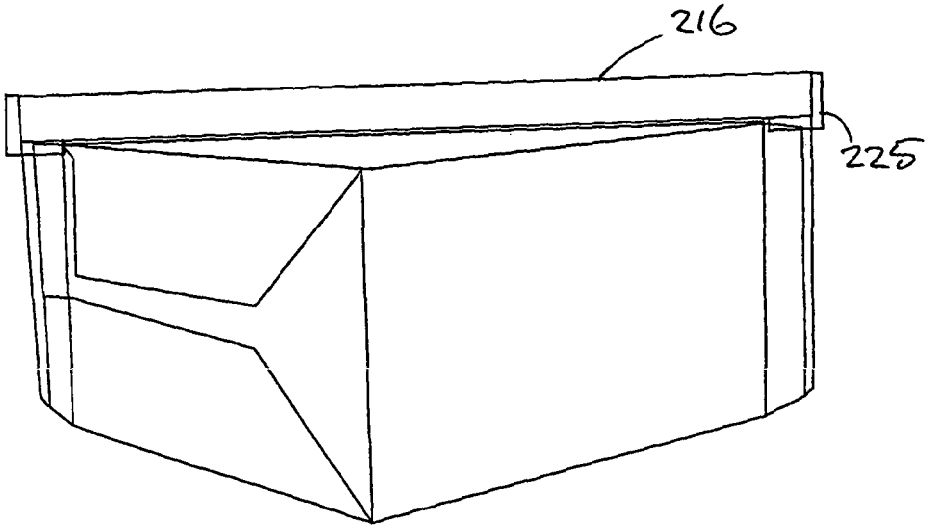

FIGS. 7*a* to 7*c* show the folding of the blank of FIG. 6 into a sandwich container;

FIG. 8 is a perspective view of the container formed from the blank of FIG. 6;

FIG. 9 is a perspective view of the container from FIG. 8 once sealed;

FIG. 10 is a plan view of a container blank according to a still further embodiment of the present invention;

FIG. 11 is a perspective view of the container formed from the blank of FIG. 10; and FIG. 12 is a perspective view of the container from FIG. 11 once sealed.

Figure 1:
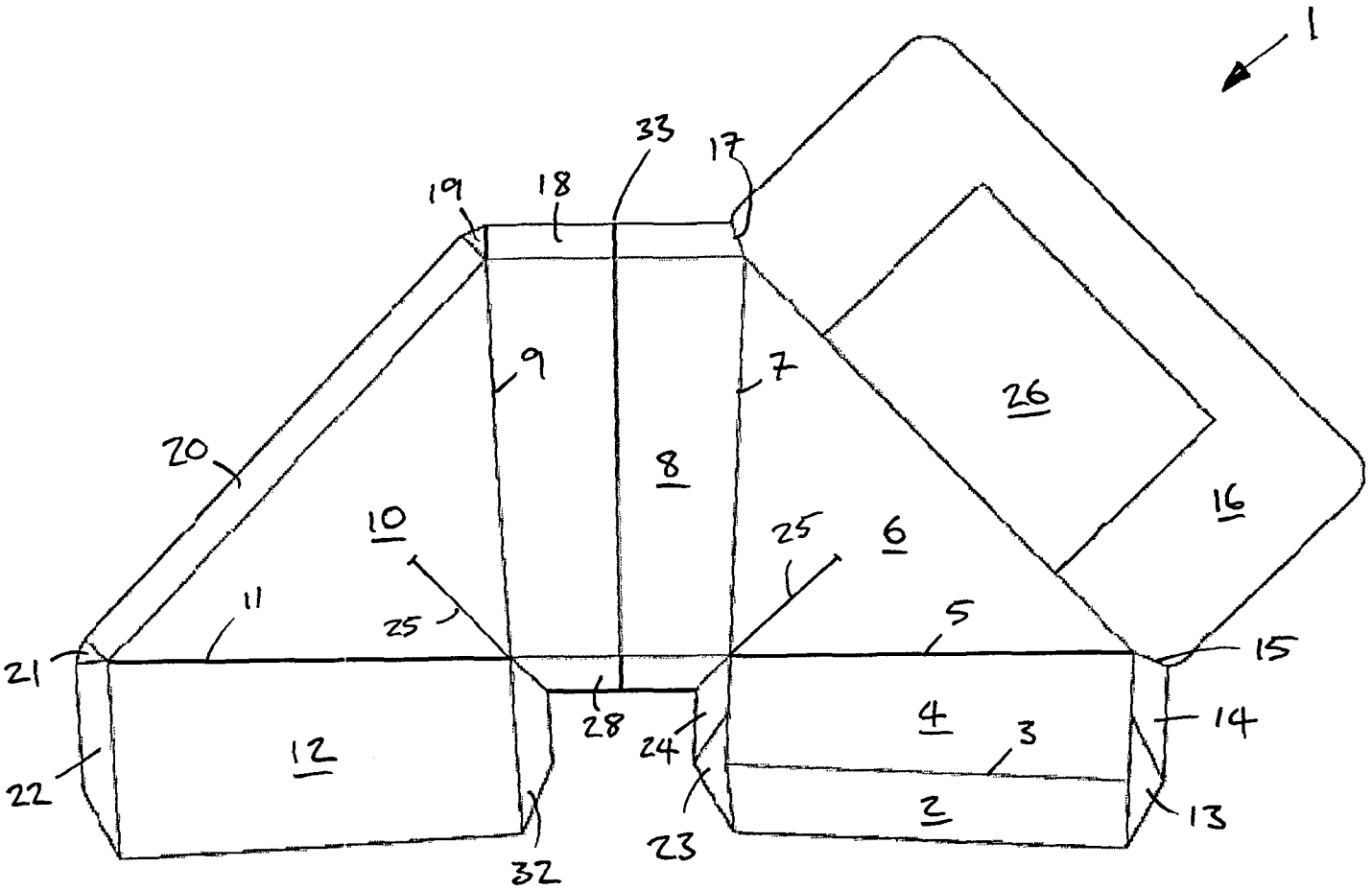
FIG. 1 is a plan view of a blank for forming a container according to the present invention.

The container blank 1 shown in FIG. 1 is for forming a triangular sandwich pack for diagonally cut sandwiches. The blank 1 comprises a substrate layer of paperboard, divided by fold lines into a number of panels. Some of these panels 4,6,8,10,12 will form the walls that define the finished container body, some panels 14,16,18,20,22 will form the closure of the finished container and the remaining panels 2,24,28,32 are provided as tabs for bonding the container body together.

Taking the blank 1 as shown in FIG. 1 and working in an anti-clockwise direction, a large tab 2 is shown joined to a first long edge of a first generally rectangular body panel 4. The second long edge of the first body panel 4 is joined to a first short edge of a second body panel 6 which is in the shape of an isosceles triangle with two short edges and a single longer edge. The second short edge of the second body panel 6 is joined to a first long edge of a third body panel 8. Like the first body panel 4, the third body panel 8 is generally rectangular, but its shorter edges are twice the length of those of the first body panel 4. A fourth, triangular, body panel 10 is joined at its first short edges to the second long edge of the third body panel 8. The fourth body panel 10 is an isosceles triangle, similar to the second body panel 6, and its second short edge is joined to a first long edge of a fifth, generally rectangular, body panel 12. The shorter edges of the fifth body panel 12 are longer than those of the first body panel 4, but shorter than those of the third body panel 8.

Figure 2:
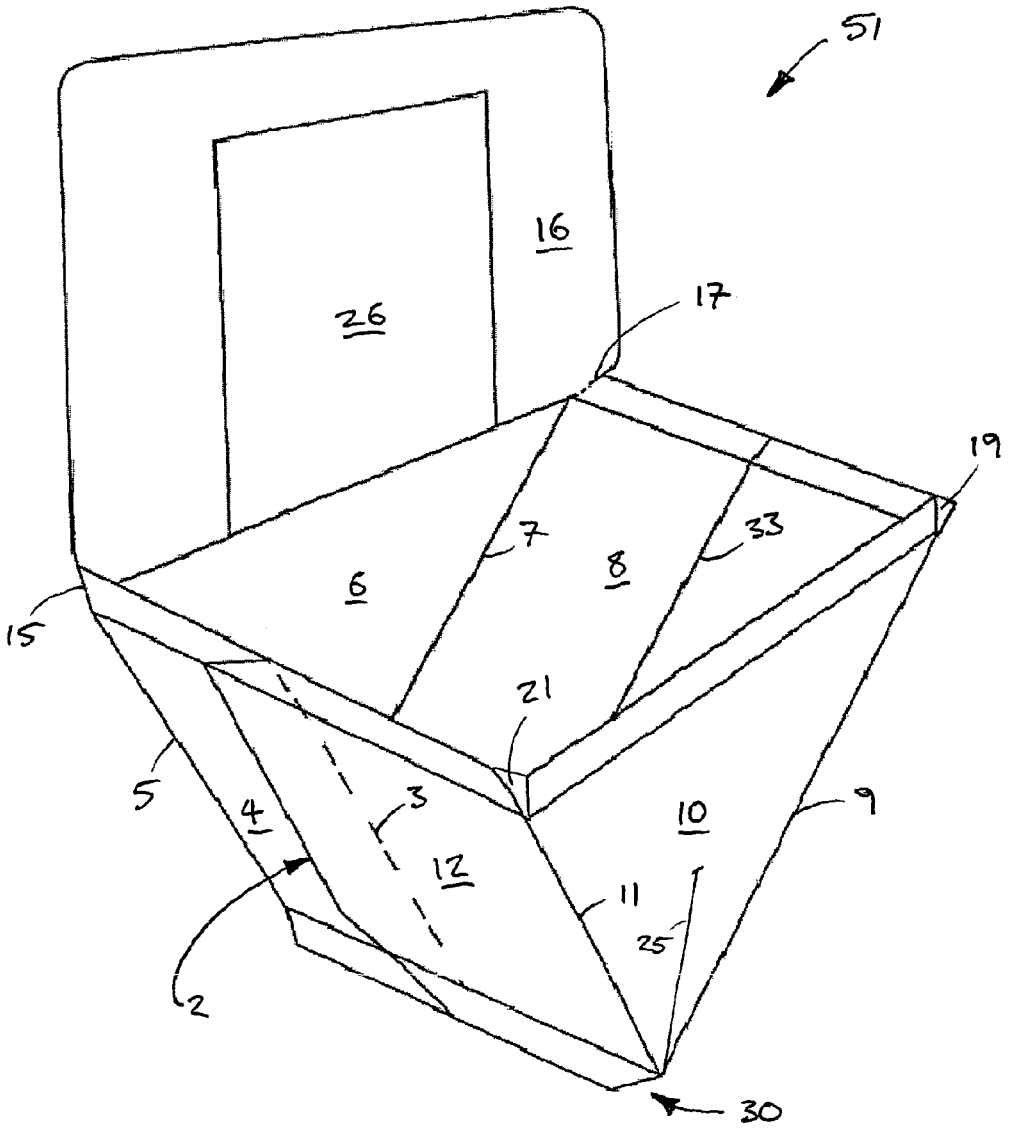
FIG. 2 is a perspective view of a container formed from the blank of FIG. 1 in an open configuration.

FIG. 2 shows a container 51 formed from the blank 1 shown in FIG. 1. The second and fourth body panels 6,10 form the triangular walls of the container, with one of the generally rectangular end walls being formed by the third body panel 8, and the other being formed by the first and fifth body panels 4,12, which are joined together by bonding the large tab 2 to a part of the fifth body panel 12. Significantly, this arrangement means that the join in the body of the container 51 where the blank 1 is bonded together is located in the middle of a wall of the container 51 rather than at a corner of the container body 51 between the container apex 30 and its opening. This means that a single fold line 5,7,9,11 between adjacent body panels forms each corner of the container body 51. A further apex fold line 25 can be seen extending approximately half way across the triangular fourth body panel 10 from the apex towards the mid point of its long edge. FIG. 1 shows that the second body panel 6 of the blank 1 is also provided with an apex panel 25 as described above. The apex fold lines 25 are beneficial in forming the container, as will be explained later.

A further fold line 3 exists between the large tab 2 and the first body panel 4, and this is shown as a dotted line in FIG. 2. Although not visible in FIG. 2, the large tab 2 is folded back against the first body panel 4 at fold line 3, so that the large tab 2 is sandwiched between the first body panel 4 and a part of the fifth body panel 12. The formation of the container 51 from the blank 1 will be described in greater detail later.

Although described as generally rectangular, each of the first, third and fifth body panels 4,8,12 actually incorporates a slight taper such that the opening of the container 51 is wider than the container apex 30. This is preferable to allow stacking of a number of empty containers 51 and to simplify the action of placing sandwiches into a container 51, but is not essential.

The blank 1 of FIG. 1 also comprises a number of closure forming panels 14,16,18,20,22 for forming a closure of the finished container 51. One closure forming panel is provided at an edge of each of the body panels 4,6,8,10,12 which, in use, defines the opening of the finished container 51 of FIG. 2. Specifically, four flange forming panels 14,18,20,22 are joined by fold lines to edges of the first body panel 4, third body panel 8, fourth body panel 10 and fifth body panel 12 respectively; and a lid panel 16 is joined by a fold line to the edge of the second body panel 6.

Small tabs 24,28,32 are provided at the edges of the first, third and fifth body panels 4,8,12 opposite to their respective flange forming panels 14,18,22. For convenience, the small tab 24 joined to first body panel 4 will be referred to as the first small tab, small tab 28 joined to the third body panel 8 will be referred to as the third small tab, and the small tab 32 joined to the fifth body panel 12 will be referred to as the fifth small tab. Similar nomenclature will be applied to the flange forming panels 14,18,20,22.

The blank 1 additionally comprises a layer of plastics film applied across the entire paperboard substrate. The plastics film provides a number of benefits, most notably preventing ingress of liquids into the paperboard substrate, providing a substantially airtight layer to enable gas flushing, and serving as a heat sealable medium to bond the finished container 51 together.

Trials have determined that one particularly suitable film comprises a layer of Ethylene Vinyl Alcohol (EVOH) between two layers of Low Density Polyethylene (LDPE). In the preferred embodiment of the present invention, the total thickness of the film is 40 microns. This represents a top layer of LDPE 18.5 microns thick, a 3 micron thick middle layer of EVOH, and a back layer of LDPE, again 18.5 microns thick. An appropriate co-extruded film is available from French company Leygatech, and exhibits the following properties:

| | | |
|---|---|---|
| Stress at break (MD/TD): | 27/16 | Mpa |
| Elongation at break (MD/TD): | 410/470 | % |
| Resistance to tear (MD/TD): | 95/205 | $Nmm^{-1}$ |

The film also exhibits a water vapour transmission rate (at 38° C. and 90% relative humidity) of less than 7.5 $gm^{-2}$/24 h, and an oxygen permeability (at 23° C. and 0% relative humidity) of 2 $cm^3$ $m^{-2}$/24 h or less.

Where gaps exist in the paperboard substrate, unsupported areas of plastics film are provided. Specifically, a first triangle 19 of plastics film is provided between the third flange forming panel 18 and the fourth flange forming panel 20, and a second triangle 21 of plastics film is provided between the fourth flange forming panel 20 and the fifth flange forming panel 22. A third triangle of film 13 is provided at the end of the fold line 3 between the large tab 2 and the first body panel 4, adjacent the first flange forming panel 14, and a fourth triangle of film 23 is provided at the opposite end of said fold line 3, adjacent the first small tab 24. Finally, a window 26 in the lid panel 16 is provided by the plastics film.

Typically, the flange of a container formed from a blank is formed in several discrete parts. This is necessary to allow the flange to be folded outwardly from the container walls without tearing the blank material. The problem with this typical arrangement is that gaps will necessarily exist between individual parts of the flange, at the corners of the finished container, which is undesirable in ensuring a good seal. In the blank 1 of FIG. 1, the first and second triangles of plastics film 19,21 are capable of stretching so that the third fourth and fifth flange forming panels 18,20,22 can be folded outwardly to form a continuous flange without the blank 1 tearing at the corners of the container 51.

FIG. 1 shows the blank 1 from what will, in use, be the outside of the finished container 51. The plastics film layer is provided over what will, in use, be the inside of the finished container 51. For simplicity, the respective surfaces of the blank will hereafter simply be referred to as the inside and outside surfaces.

In order to ensure that gaps do not exist at the corners of the container 51 at opposite ends of the lid panel 16, the lid panel 16 is joined to the first and third flange forming panels 14,18 by two angled extensions 15,17 of the fold line between the lid panel 16 and the second body panel 6.

Figure 3:
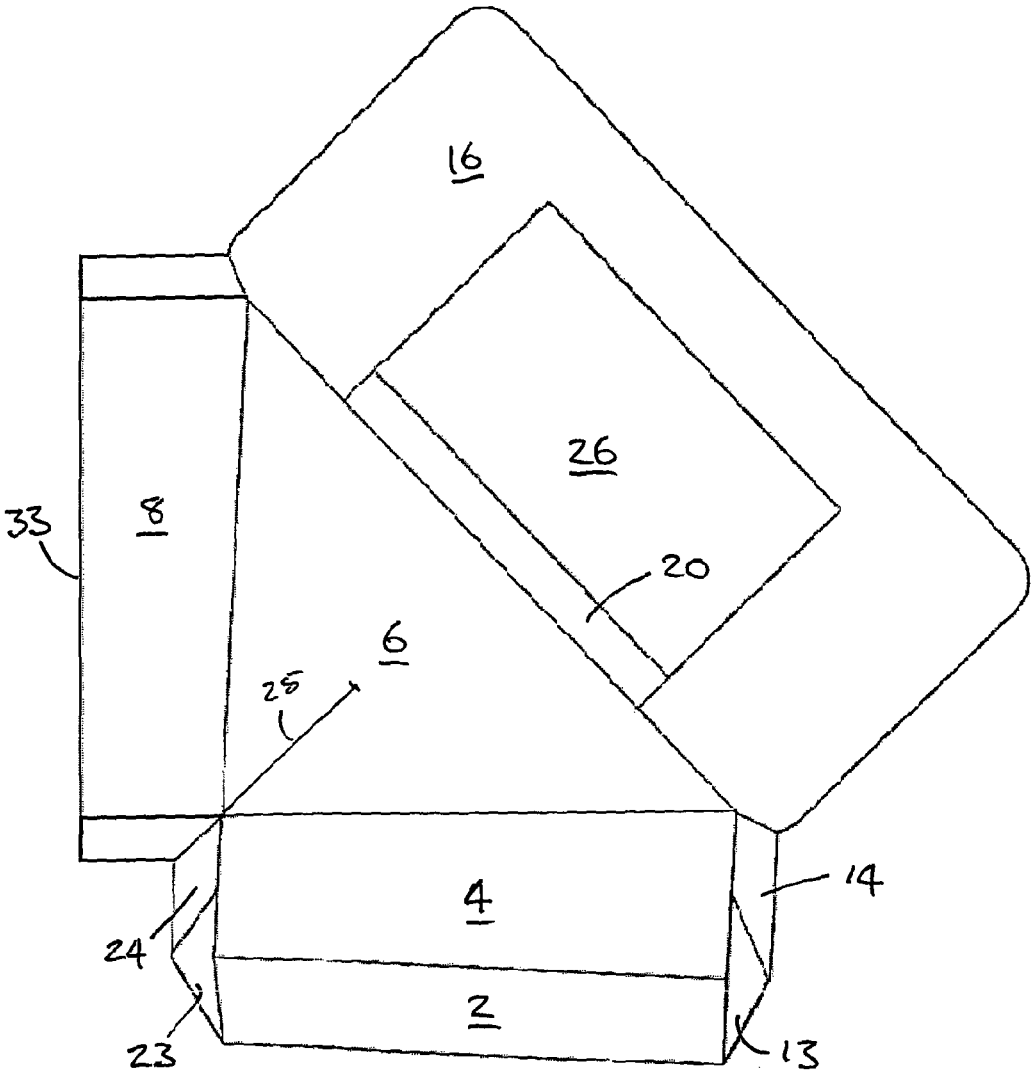
FIG. 3 is a plan view showing the blank of FIG. 1 folded in half.

FIG. 3 shows the first step in forming the container 51 shown in FIG. 2 from the blank 1 shown in FIG. 1. The blank 1 is shown folded in half along fold line 33, which is provided in third body panel 8, third flange forming panel 18 and third small tab 28. The fourth and fifth body panels 10,12 have been folded underneath the second and first body panels 6,4 and the large tab 2 such that the inside surfaces of two halves of the blank are in contact. The fifth flange forming panel 22 underlies the first flange forming panel 14 and the third triangle of film 13, while the fifth small tab 32 underlies the first small tab 24 and the fourth triangle of film 23. The fourth flange forming panel 20 is visible through the window 26 in the lid panel 16.

Once the blank 1 is folded as shown in FIG. 3, heat is applied to bond the large tab 2 to the edge of the underlying fifth body panel 12. Specifically, heat is applied to the underside of the folded blank as shown, to the outside surface of the area of the fifth body panel 12 underlying the large tab 2 and the ends of the third and fourth triangles of plastics film 13,23 beyond the fold line 3. No heat is directly applied to the third and fourth triangles of film 13,23 visible in the view of FIG. 3 so as to avoid damaging the plastics film. This will be described further later. However, the application of heat to the fifth body panel 12 is sufficient, in most instances, to seal the overlying parts of the third and fourth triangles of plastics film 13,23 to the fifth body panel 12.

Figure 4:
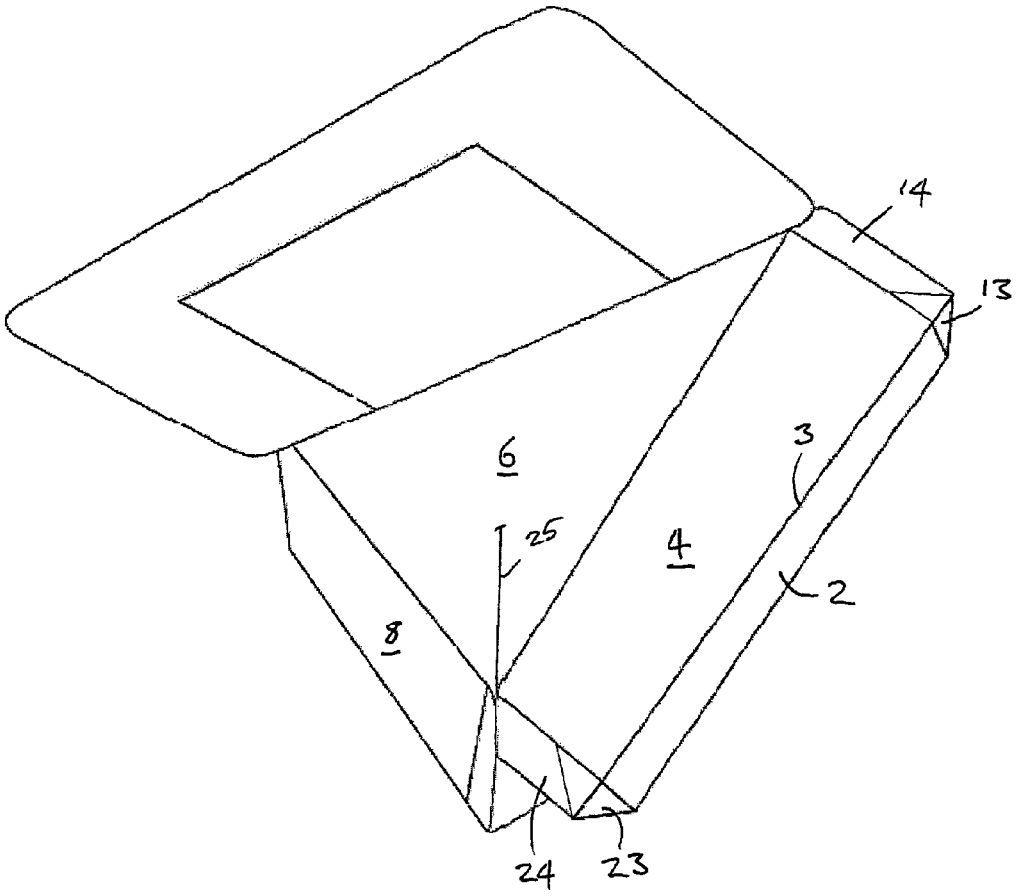
FIG. 4 is a perspective view showing the forming of a container from the folded blank of FIG. 3.

The next stage of forming the container 51 is to separate the triangular second and fourth body panels 6,10 such that the third body panel 8 flattens out and the large tab 2 folds back against the first body panel 4 at the fold line 3 between the large tab and the first body panel 4. FIG. 4 attempts to show this opening process. The large tab 2 is being folded back against the first body panel 4, and this is causing the third and fourth triangles of film 13,23 to fold double. The fifth body panel 5 is obscured from view, but it should be noted that angled edges of the paperboard substrate of the fifth flange forming panel 22 and the fifth small tab 32 coincide with the angled edges of the third and fourth triangles of film 13,14 visible in FIG. 4.

The heat sealing process used to seal the apex 30 of the container 51 typically involves separating the triangular body panels 6,10 as described above and pinching the small tabs 24,28,32 together between heated rollers. Problems can arise if this action of pinching the apex 30 of the container 51 is resisted by the triangular walls 6,10 of the container 51. There is a risk either that the small tabs 24,28,32 will not be held together sufficiently tightly during the heat sealing, or that the material in the triangular walls 6,10 will be stressed by the process. Both of these problems can be mitigated by the provision of apex fold lines 25 extending from the apex of each triangular wall 6,10. The apex fold lines 25 allow the triangular walls 6,10 to deform in a controlled way when the pack 51 is pinched at the apex 30 when heat sealing the small tabs 24,28,32. The precise length of the apex fold lines 25 is not critical, and they may be shorter than shown in the figures. It is preferable that the apex fold lines do not extend more than half way across the triangular wall panels 6,10 so that the walls of finished container 51 maintain a degree of rigidity.

Figure 5:
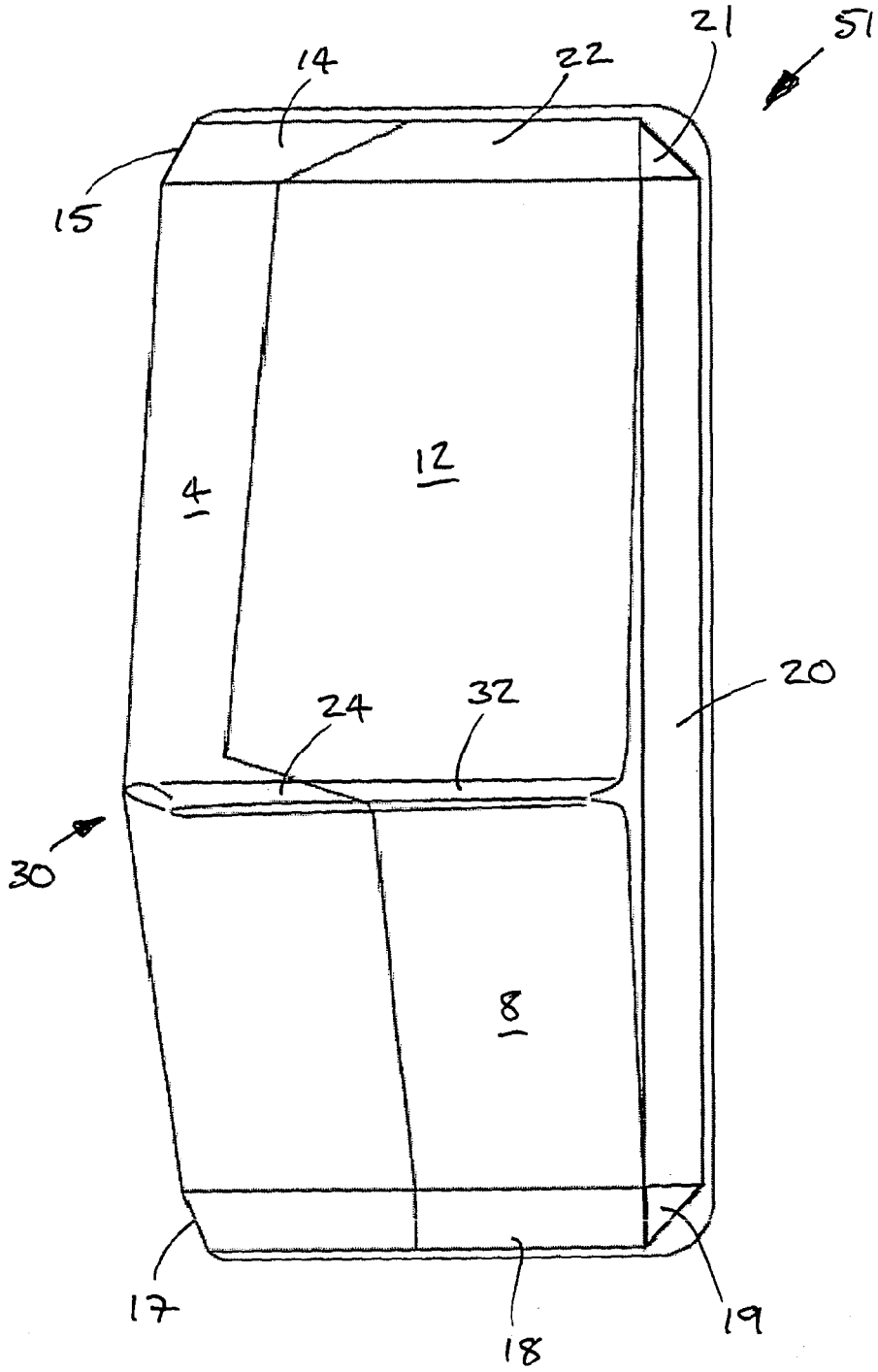
FIG. 5 is a view from the apex of the container of FIG. 2 showing the container in a closed/sealed configuration.

When the container 51 is fully opened out and the large tab 2 is folded completely flat against the outside of the first body panel 4, the angled edges of the fifth flange forming panel 22 and the fifth small tab 32, clearly shown in FIGS. 1 and 3, abut the angled edges of the first flange forming panel 14 and first small tab 24. This is best seen in FIG. 5, which shows a view from the apex 30 of the completed container 51. The result is that, when the container 51 is completely formed, there is no exposed film on the exterior of the container 51. This improves the outward appearance of the container 51, as well as providing further benefits as described below.

The plastics film of the blank 1 is susceptible to heat sealing, but may also be damaged if subjected to too high a temperature during the heat sealing process. Typically, heat sealing of containers takes place at around 200° C., but temperatures in excess of 100° C. have been found to cause damage to any exposed plastics material. Any loss of integrity in the plastics film can lead to a loss of integrity of the finished container, so needs to be avoided.

As can be seen in FIG. 5, there is no exposed plastics film either at the apex 30 of the container 51 where the small tabs 24,28,32 are heat sealed together, nor is there any exposed plastics film where the first and fifth flange forming panels 14,22 are heat sealed to the lid panel to close the container. When forming the container 51 the heat can therefore be applied to the outside of the container on both sides of the area to be sealed. The paperboard substrate layer protects the film from the direct application of heat and avoids it being damaged and/or losing integrity during the heat sealing process.

Although it is important to protect the plastics film from very high temperatures as described above, the heat applied to the pack still needs to be transferred to the film in order for a reliable film to be formed. Therefore, it is undesirable for there to be an excess of material between the applied heat source and the heat sealable film, in particular if the excess is only in certain areas since this would require heat to be applied to different parts of the container 51 for different lengths of time. This problem does not arise with the blank 1 of FIG. 1 because, as described above, the angled edges of the fifth flange forming panel 22 and the fifth small tab 32 abut the angled edges of the first flange forming panel 14 and first small tab 24. The respective parts of the container, when formed, thus only comprise a single layer of paperboard overlying a doubled layer of plastics film.

The doubling of each of the third and fourth triangles of film 13,23 also provides an improved seal to the container. Straight seals or joins between parts of a container can serve as a 'rat run' allowing a route for gas to flow into or out of the container. The folding of the film triangles 13,23, along with the angled line at the join between the first and fifth flange forming panels 14,22 and between the first and fifth small tabs 24,32 provides a more tortuous route for any gas trying to enter or escape from the container 51, thereby further improving the integrity of the container 51.

FIG. 5 also shows how the first and second film triangles 19,21 have stretched to span respective gaps between the third and fourth flange forming panels 18,20 and between the fourth and fifth flange forming panels 20,22. At the opposite corners of the container 51, the angled extensions 15,17 of the fold line where the lid panel 16 is joined to the first and third flange forming panels 14,18 can be seen. Referring briefly again to FIG. 2, it can been seen that when the lid panel 16 is in an open position the connection between the lid panel 16 and the first and fifth flange forming panel 14,18 causes the first and fourth flange forming panels 14,18 to extend upwardly from the container opening. As the lid is closed, the flange forming panels 14,18 fold outwardly and may then be sealed to the inside of the lid panel 16 as shown in FIG. 5. The angles of the extensions 15,17 of the fold line allow the lid panel 16 to be permanently attached to the first and third flange forming panels 14,18 without placing undue strain on any part of the blank 1 during its folding to form the container 51. Even if folding were to cause damage to the paperboard around the angled extensions 15,17 of the fold line, the continuous layer of plastics film on the interior of the container 51 would maintain the integrity of the seal.

The finished container 51 comprises four walls, with the folded over large tab 2 and the edge of the fifth body panel 12 to which it is joined providing a further, fifth, panel. The further panel provides additional strength and rigidity to the wall that will, in use, form the base of the finished container 51. The extra material in the further panel also provides extra weight to the base wall which slightly improves the stability of the container 51 in use.

The invention is not considered to be limited to the configurations and materials described above. For example, from the above description it should be clear that the provision of a fold line 33 in the third body panel 8 of the blank 1 simplifies the initial stage of forming the container 51 by allowing the entire blank 1 to be folded in half so that the large tab 2 can be easily bonded to the fifth body panel 12. However, it should be noted that it would be possible to form the same container 51 without the fold line 33 in the third body panel 8 by instead folding each panel 2,4,6,8,10 in turn and bonding the same parts together.

Furthermore, it should be noted that the advantages of the invention in ensuring that all corners of the container opening are provided by fold lines would still improve the seal of a container if the container were provided with a flange around its entire opening and a lid panel were provided as a separate piece.

FIGS. 6 to 12 show blanks for a further sandwich container in unassembled, part assembled and assembled states. It will be understood that the features shown and described will, in many cases, also be applicable to blanks for containers for a variety of other purposes, and to the container and blanks shown in FIGS. 1 to 5.

FIG. 6 shows a blank 100 which, in use, is folded to form a sandwich container 101 as shown in FIG. 8.

For the purposes of description herein, the terms "left and "right" and derivatives thereof shall be related to the invention as oriented in FIG. 6, as if the blank 100 were setting on a table and viewed from above. However, it is to be understood that the invention may assume various alternative orientations, except where expressly specified to the contrary.

The blank 100 of FIG. 6 comprises left and right triangular side panels 102,103 and first and second generally rectangular end panels 104,105. As shown in FIG. 6, the end panels 104,105 incorporate a slight taper so that the finished container 101 has an opening slightly larger than its apex, but this is not essential.

The left and right triangular side panels 102,103 extend, respectively, from left and right edges of the first end panel 104 and perpendicular thereto and the second end panel 105 extends below and from a narrow end of the rectangular first panel 104. The triangular side panels 102,103 are the same size as one another and both right-angled triangles. The generally rectangular end panels 104,105 are also the same size as one another.

Left and right webbing sections 106,107 extend on either side of the second end panel 105 and connect left and right edges of the second end panel 105 to a bottom edge of the left and right side panels 102,103 respectively. Both webbing sections 106,107 comprise two portions denoted in FIG. 6 by the suffix 'a' and 'b' with a webbing fold line 108 between webbing portions 106*a* and 106*b* and a webbing fold line 109 between webbing portions 107*a* and 107*b*.

Both webbing fold lines 108,109 extend at approximately 45 degrees from the top left and top right corners of panel 105 respectively such that webbing fold line 108 is equidistant from the left edge of panel 105 and the bottom edge of panel 102 and, similarly, webbing fold line 109 is equidistant from the right edge of panel 105 and the bottom edge of panel 103.

A panel fold line 110 is provided between each webbing portion 106,107 and adjacent panel and a flange 111 is shown around the edge of the blank 100. The flange 111 is formed in a number of discrete sections 121,122,123,124, which are joined by flange fold lines 112 to first end panel 104, right side panel 103, second end panel 105 and webbing portion 106*a* respectively. Further panel fold lines 113 are provided at the join of the first and second end panels 104,105 and between panels 102 and 104 and between panels 103 and 104. In this embodiment, the fold lines 108,109,110,112 and 113 are all formed as creases.

A generally rectangular closure/lid panel 114 for closing the finished container extends from the hypotenuse of triangular side panel 102 and is connected thereto by a lid fold line 115. Significantly, the closure 114 is joined to the flange sections 121,124 adjacent to it by an angled extension at each end of fold line 115.

Diagonal fold lines 116 are provided at the free corners 117 of the closure panel 114 such that said corners 117 can be folded back once the finished container 101 is closed. The closure panel also comprises a window portion 118.

In the illustrated embodiment, the blank 100 comprises a paperboard substrate with a liquid impermeable film coating. The film coating covers the entire substrate and also forms the window 118 in the closure panel 114. Small areas of overhanging film 125 are provided around the corners 117 of the closure panel 114, and further areas of overhanging film 126 are provided at a short edge of each of flange sections 121 and 123. Although not shown, it is also envisaged that further areas of film overhang could be provided, for example extending beyond fold line 108 between adjacent webbing portions 106*a* and 106*b* and/or beyond fold line 109 between webbing portions 107*a* and 107*b*. Film overhangs could also be provided at the free ends of webbing portions 106*b* and 107*b*, outside flange section 123 and/or at the ends of flange section 122. The film layer may even bridge gaps between adjacent panels of the container blank, such as adjacent flange sections in the same way as film triangles 19 and 20 of the blank 1 shown in FIG. 1. In this case, the film layer should be capable of stretching so as not to prevent the flange sections from being folded outwardly when the container is formed. Trials have determined that one particularly suitable film comprises a layer of Ethylene Vinyl Alcohol (EVOH) between two layers of Low Density Polyethylene (LDPE). An appropriate co-extruded film is available from French company Leygatech. However, other films exhibiting similar elongation and tear resistance may also be used.

In another embodiment, flange section 124 may be provided solely as a layer of film extending beyond the edge of a paperboard substrate. The edges of the film flange portion 124 may terminate as shown in FIG. 6, or may extend beyond the edge shown to provide a larger flange area as would be the case where a film overhang is provided around the paperboard flange 124. Furthermore, a further flange section, similar to section 124, could be provided at the free edge of webbing portion 107*a*. This additional flange section may also be provided with a film overhang or provided solely as a layer of film in the same way as flange section 124. When provided solely by a film layer, the additional flange forming portion may be joined to adjacent flange portion 122.

FIGS. 7*a* to 7*c* illustrate the folding of the blank 100 to form the finished container 101 shown in FIG. 8. The blank 100 is first folded at right angles along fold lines 110 between side panels 102,103 and webbing portions 106*a*, 107*a* and along fold line 113 between end panels and 105 as shown in FIG. 7*a*. Next, as shown in FIG. 7*b*, the blank is folded along the fold line 113 between first end panel 104 and the right side panel 103 such that the right side panel 103 bridges the gap between the first an second end panels 104,105. As a result, an oppositely directed fold is also formed at fold line 109 between webbing sections 107*a* and 107*b*, which overlie one another and protrude from the outside of the now partially formed container. A similar folding operation is then carried out between the first end panel 104 and the left side panel 102 to arrive at the configuration shown in FIG. 7*c*. To complete the container body, webbing sections 106 and 107 are folded flat against, and bonded to, the outside of second end panel 105 and the flange sections 121,122,123,124 are folded outwardly to form a flange 111 around the opening of the container. In this process, flange section 124 is made to overlie flange section 123 on the exterior of the container. The rigidity of flange section 123 allows flange section 124, and the further optional flange section at the end of webbing portion 107*a*, to comprise only film as described above. The flexibility gained by omitting the paperboard layer from these flange sections helps to provide an improved seal at this end of the finished container.

FIG. 8 shows the finished container 101 viewed from its vertex at fold line 113 between first and second end panels 104,105, and shows the flange 111 folded back at the flange fold lines 112 around the edge of the container. The generally rectangular closure 114 has been folded along fold line 115 and bonded to the flange 111 to close the container 101. As mentioned above, closure 114 is joined to the flange sections 121,124 adjacent to it by angled extensions to fold line 115 so that there is no gap in the flange 111 at the side of the finished container 101 where the lid fold line 115 is provided. However, gaps 127 do exist in the flange 111 at the corners of the container 101 between flange sections 121 and 122, and between sections 122 and 123.

As shown in FIG. 9, the gaps 127 are covered by folding back the corners 117 of the closure panel 114 at fold lines 116 and bonding them to the opposite side of the flange 111. The overhanging film 125 provided at the corners 117 extends around the corners of the container 101 to further improve the seal. The sealing of the closure 114 to the flange 111 in the region of the gaps 127 is improved by the overhanging film areas 126 at the ends of flange panels 121 and 123 (not shown). The resulting pack eliminates all gaps from the interface between the flange 111 and the closure 114, thereby providing an improved hermetic seal to the finished container.

FIG. 10 shows a blank 200 which represents an alternative embodiment of the present invention. Many features of the blank 200 are identical to those of the blank 100 of FIG. 6, so these will not be described again. The key difference is that the closure 214 of the alternative blank 200 is wider, and is provided with a single fold line 216 along its entire length. An edge portion 217 of the closure 214 is located outside the fold line 216, and film overhangs 225 are provided at the corners of the closure 214 as in the first embodiment.

FIG. 11 shows a container 201 formed from the blank 200 of FIG. 10. The formation of container 201 is exactly as described above in relation to the first embodiment. However, it can be seen in FIG. 11 that the edge portion 217 of closure panel 214 extends beyond the flange 211 such that fold line 216 is located adjacent the edge of the flange 211. To cover the gaps 227 in the flange 211 the edge portion 217 of closure panel 214 is folded along fold line 216 and bonded to the opposite side of the flange 211, in particular to flange section 222 along the long edge of the container 201.

FIG. 12 shows the container 201 of the second embodiment with the closure panel 214 folded and bonded as described above. The film overhangs 225 serve essentially the same purpose as described in relation to the first embodiment.

In use, a food item such as a sandwich is placed inside the container 101,201 and the container 101,201 is, as described above, hermetically sealed. As a result, it becomes possible for the sealing of the container 101,201 to comprise a 'gas flushing' step, or modified atmosphere packaging technique. The gas flushed container is capable of retaining inert gas for at least 14 days. This further extends the shelf-life of any food items stored therein.

The invention is not considered to be limited to the configurations and materials described above. For example, the lid/closure panel may be bonded to a long side of a flange section, or may be provided as an entirely separate component. Alternatively, or additionally, further foldable portions could be provided on the closure panel as required.

Further means of improving the sealing may also be provided. For example, discrete, generally circular, heat activated resin dots may be located proximate each of the four corners of the closure 114,214, on the interior face. Said resin dots should be positioned so as to coincide with vertices on the container 101,201 so as to be able to flow into and/or around each vertex when heated to hermetically seal the closure 114,214 thereto. After removal of a heat source, each resin dot sets and, in combination with the bonding of the closure 114,214 to the flanges 111,211, forms a hermetic seal.

The container may also comprise a frangible opening, possibly provided by a first score line on the interior surface of the closure panel 114,214 and a second score line on the exterior surface of the flange 111,211. The portions 117,217 of the closure 114,214 that fold over the flange 111,211 can be used to initiate a tear along said score lines to ease opening of the container.

Although primarily concerned with providing an airtight container, in certain applications it may be preferable for the container to have a degree of permeability so that the contents are allowed to 'breathe'. This is important in particular for certain foodstuffs, such as cheeses. This can be achieved in any of the embodiments described above either through the use of an alternative film layer with an inherent degree of air permeability, of through the perforation of a plastics film as described above.

The invention claimed is:

1. A container for a food product, the container comprising:

a body formed by folding a blank, the formed body having an opening for receiving the food product;

an outwardly projecting flange provided around at least a part of the opening, the outwardly projecting flange comprising a paperboard material; and a lid which is, in use, bonded to the outwardly projecting flange to close the formed body, wherein the lid shares a first fold line with the outwardly projecting flange, and wherein the outwardly projecting flange extends outwardly from a body panel of the body when the body is formed.

2. The container according to claim 1, wherein the first fold line is an angled extension of a second fold line between the lid and the formed body.

3. The container according to claim 2, wherein the container comprises a paperboard substrate and a liquid impermeable film.

4. The container according to claim 3, wherein the layer of film extends beyond an edge of the paperboard substrate to create at least one film overhang.

5. The container according to claim 4, wherein the at least one film overhang forms a part of the flange.

6. The container according to claim 5, wherein said part of the flange is sealed to the lid during closure of the formed body.

7. The container according to claim 3, wherein the film comprises a plurality of layers of plastic material.

8. The container according to claim 7, wherein the film is coextruded.

9. The container according to claim 8, wherein the film comprises a layer of Ethylene Vinyl Alcohol (EVOH) between two layers of Low Density Polyethylene (LDPE).

10. The container according to claim 1, wherein the blank comprises webbing sections between panels which form adjacent walls of the finished container, the webbing sections being folded and bonded to an outside of the container.

11. A container for a food product, the container comprising:

a body formed by folding a blank, the formed body having an opening for receiving the food product;

a corner of the container opening being at an end of a fold line between two body panels forming adjacent walls of the container body;

an outwardly projecting flange provided around at least a part of the opening, the outwardly projecting flange comprising a paperboard material; and a lid which is, in use, bonded to the outwardly projecting flange to close the formed body, wherein the lid is joined to a first of the two body panels forming adjacent walls of the container body by a fold line and the flange is joined to a second of the two body panels by a fold line, and the lid shares a first fold line with the outwardly projecting flange.

* * * * *